US008210612B2

(12) United States Patent
Adams et al.

(10) Patent No.: US 8,210,612 B2
(45) Date of Patent: Jul. 3, 2012

(54) TENSION FABRIC LUMBAR SUPPORT SYSTEM

(75) Inventors: Chad E. Adams, Perrysburg, OH (US); Larry P. LaPointe, Temperance, MI (US); Mark D. McClung, Grandview, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 82 days.

(21) Appl. No.: 12/836,116

(22) Filed: Jul. 14, 2010

(65) Prior Publication Data

US 2012/0013161 A1 Jan. 19, 2012

(51) Int. Cl.
*A47C 7/14* (2006.01)
*A47C 7/46* (2006.01)

(52) U.S. Cl. ..... 297/284.4; 297/284.2

(58) Field of Classification Search ..... 297/284.1, 297/284.2, 284.4, 452.56, 452.63
See application file for complete search history.

(56) References Cited

U.S. PATENT DOCUMENTS

| | | | | |
|---|---|---|---|---|
| 3,258,259 | A * | 6/1966 | Bohlin | 297/284.2 X |
| 4,309,058 | A * | 1/1982 | Barley | 297/284.4 |
| 4,712,834 | A * | 12/1987 | Warrick | 297/284.2 |
| 4,858,992 | A * | 8/1989 | LaSota | 297/284.2 |
| 5,058,952 | A * | 10/1991 | LaSota | 297/284.2 |
| 5,507,559 | A * | 4/1996 | Lance | 297/284.4 X |
| 6,082,825 | A * | 7/2000 | Simon | 297/452.63 |
| 6,412,868 | B1 * | 7/2002 | Kuster et al. | 297/284.4 |
| 6,604,792 | B1 * | 8/2003 | Picard | 297/452.56 |
| 6,722,742 | B2 * | 4/2004 | Potes et al. | 297/452.56 |
| 6,786,544 | B1 * | 9/2004 | Muraishi | 297/452.56 X |
| 6,837,541 | B2 * | 1/2005 | Farquhar et al. | 297/284.4 X |
| 6,854,805 | B2 * | 2/2005 | Fujita et al. | 297/452.56 |
| 6,991,288 | B2 * | 1/2006 | Farquhar et al. | 297/284.4 X |
| 7,044,551 | B2 * | 5/2006 | Fujita et al. | 297/284.4 |
| 7,128,372 | B2 * | 10/2006 | Farquhar et al. | 297/284.4 |
| 7,731,294 | B2 * | 6/2010 | Yasuda et al. | 297/452.56 |
| 7,806,477 | B2 * | 10/2010 | LaPointe et al. | 297/284.4 |
| 2004/0000804 | A1 | 1/2004 | Groth | |
| 2009/0218873 | A1 | 9/2009 | LaPointe | |

FOREIGN PATENT DOCUMENTS

| | | | | |
|---|---|---|---|---|
| FR | 2587201 | A1 * | 3/1987 | 297/284.2 |
| KR | 10-2010-0008899 | | 1/2010 | |
| WO | WO 0032075 | A1 | 6/2000 | |

OTHER PUBLICATIONS

International Search Report for PCT/US2011/038669 mailed Feb. 9, 2012.

Written Opinion of the International Searching Authority for PCT/US2011/038669 mailed Feb. 9, 2012.

* cited by examiner

*Primary Examiner* — Rodney B White

(74) *Attorney, Agent, or Firm* — Harness, Dickey & Pierce, P.L.C.

(57) ABSTRACT

An occupant lumbar support system for a furniture member includes a belt member having a longitudinally elastically flexible first portion having opposite first and second ends and a longitudinally inelastic second portion. The first portion is connected to the second portion at the first and second ends. The second portion when spaced freely away from the first portion except at the first and second ends defines a belt member free state. The second portion has opposed first and second connecting ends extending freely away from the first and second ends. First and second tensioning members are each connected to one of the first and second connecting ends whereby operation of the first and second tensioning members longitudinally elastically stretches the first portion until the second portion moves into substantially continuous contact with the first portion between the first and second ends defining a belt member aggressive state.

29 Claims, 8 Drawing Sheets

TENSION FABRIC LUMBAR SUPPORT SYSTEM

FIELD

The present disclosure relates to lumbar support systems for furniture including occupant support members.

BACKGROUND

This section provides background information related to the present disclosure which is not necessarily prior art.

Conventionally, reclining articles of furniture (i.e., chairs, sofas, loveseats, and the like), referred to hereinafter generally as reclining chairs, utilize a mechanism to bias a leg rest assembly in extended and stowed positions and separate components to allow a back seat member to recline with respect to a seat base. The leg rest assembly is operably coupled to a drive mechanism to permit the seat occupant to selectively move the leg rest assembly between its normally retracted (i.e., stowed) and elevated (i.e., extended or protracted) positions.

Known furniture member mechanism designs can also permit the reclining chair to rock in a front-to-back motion with respect to an occupant or provide features that enhance the comfort of an occupant of the furniture member. One such comfort feature is occupant lumbar support. Occupant lumbar support is commonly provided by one or more cushion members that abut with or are connected to a horizontally configured flexible member. This member is commonly joined at its ends to vertically oriented backrest side support arms which are in turn rotatably connected to a furniture member chair frame. The lumbar support system thus created is typically non-adjustable.

Because lumbar support is substantially fixed to the back seat member, as the back seat member rotates the lumbar cushion(s) will commonly extend forwardly and upwardly. This creates a different lumbar support "feeling" for the different rotated positions of the seat back. Because common lumbar support systems are not adjustable by the occupant, they therefore can result in discomfort in either the fully reclined or upright positions, or in the leg rest extended position for different occupants.

SUMMARY

This section provides a general summary of the disclosure, and is not a comprehensive disclosure of its full scope or all of its features.

According to several embodiments of the present disclosure, an occupant lumbar support system for a furniture member includes a belt member having a longitudinally elastically flexible first portion attached at opposite first and second ends to a longitudinally rigid second portion. The second portion is spaced freely away from the first portion except at the attached first and second ends defining a belt member free state.

According to other embodiments, an occupant lumbar support system for a furniture member includes a belt member having a longitudinally elastically flexible first portion having opposite first and second ends and a longitudinally inelastic second portion. The first portion is connected to the second portion at the first and second ends. The second portion when spaced freely away from the first portion except at the first and second ends defines a belt member free state. The second portion has opposed first and second connecting ends extending freely away from the first and second ends. First and second tensioning members are each connected to one of the first and second connecting ends whereby operation of the first and second tensioning members longitudinally elastically stretches the first portion until the second portion moves into substantially continuous contact with the first portion between the first and second ends defining a belt member aggressive state.

According to still other embodiments, a furniture member lumbar support system includes a furniture member back support portion rotatably connected to a base portion, the back support portion including opposed first and second wings. A lumbar support system is connected to the back support portion. The lumbar support system includes a support tube connected to the first and second opposed wings. A belt member having a longitudinally elastically flexible first portion is attached at opposite first and second ends to a longitudinally inelastic second portion. First and second tensioning members connect the belt member to the support tube.

According to further embodiments, a furniture member lumbar support system is connected to a back support portion of a furniture member. A support tube is connected to first and second opposed wings of the back support portion. A belt member having a longitudinally elastically flexible first portion is attached at first and second ends to a longitudinally inelastic second portion. The second portion further includes first and second connecting ends extending away from the first and second ends. First and second tensioning members are connected to the support tube and movably support the belt member. First and second rotating drums are each rotatably connected to the support tube and each rollably engage one of the first and second connecting ends to align the first and second connecting ends with the first and second tensioning members.

According to still further embodiments, a furniture member lumbar support system connected to a back support portion of a furniture member includes a support tube connected to the first and second opposed wings. A belt member having a longitudinally elastically flexible first portion is attached at first and second ends of the first portion to a longitudinally inelastic second portion. The second portion further includes first and second connecting ends extending away from the first and second ends. First and second tensioning members connect the belt member to the support tube. First and second rotating drums are each rotatably connected to the support tube and each rollably engage one of the first and second connecting ends to align the first and second connecting ends with the first and second tensioning members.

According to further embodiments, a method is provided for creating an occupant lumbar support system connected to first and second opposed wings of a furniture member back support member. The occupant lumbar support system includes a flexible occupant lumbar belt member having an elastically extendable first portion and an inelastic second portion, a support tube, first and second tensioning members and first and second rotating drums. The method comprises connecting the support tube to the first and second opposed wings; attaching the first portion of the belt member to the second portion at first and second ends of the first portion; extending first and second connecting ends of the second portion away from the first and second ends of the first portion; fixing the first and second connecting ends to first and second tensioning members; and rotatably connecting the first and second rotating drums to the support tube to rollably engage one of the first and second connecting ends to one of the first and second rotating drums to align the first and second connecting ends with the first and second tensioning members.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
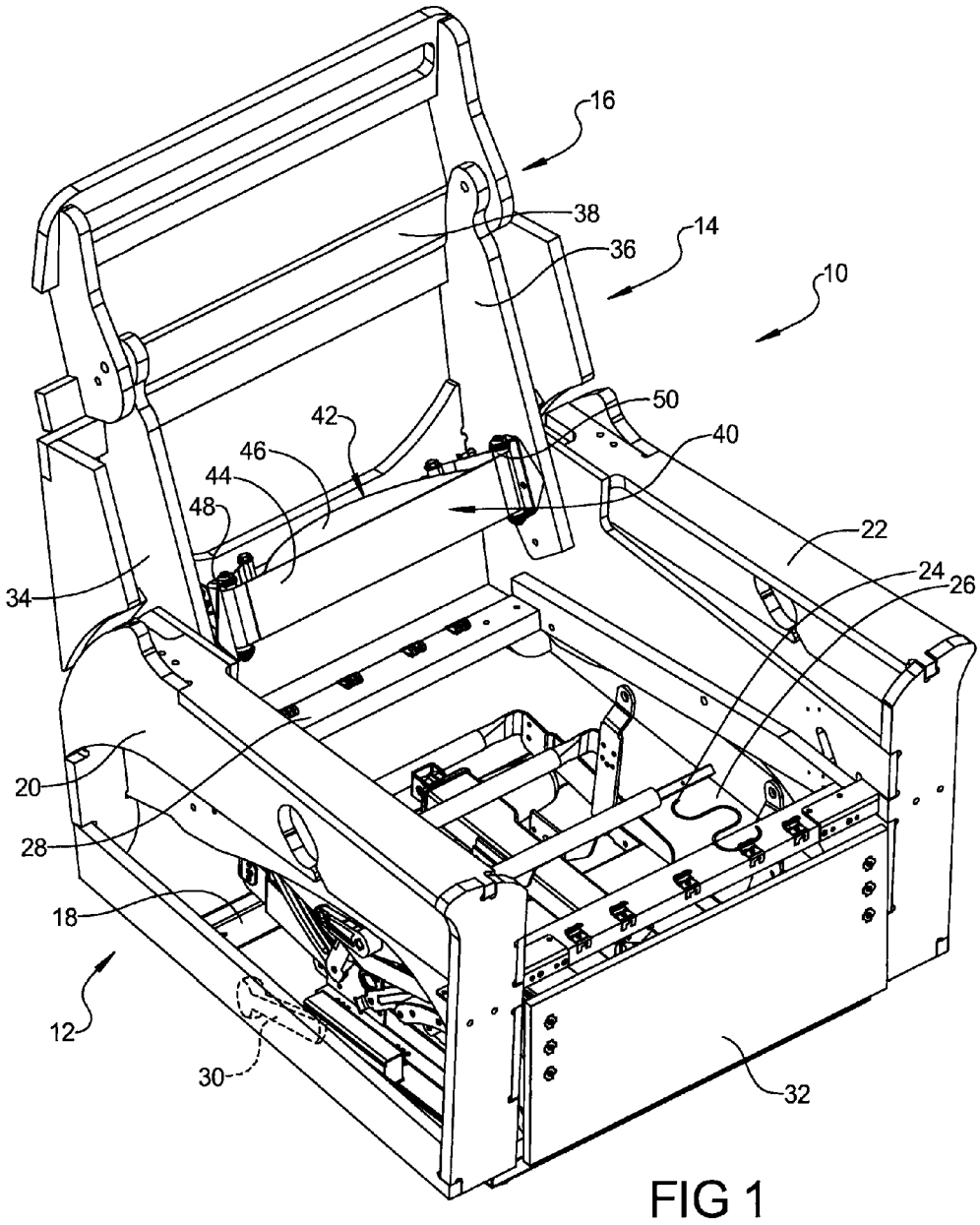
FIG. 1 is a front right perspective view of a furniture member having a lumbar support system of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, a furniture member 10 of the present disclosure is presented generally in the form of a rocking, reclining chair, however furniture member 10 can be any type of seating or occupant support member including a sofa, love-seat, sectional member, non-rocking reclining chair or the like. Common furniture items including padding, upholstery, cushions, and the like are not shown for clarity. Furniture member 10 includes a base portion 12 which can fixedly or rotatably support a back support portion 14. According to several embodiments, a head rest portion 16 can be connected to back support portion 14 which can be fixed or rotatable with respect to back support portion 14. A base support section 18 which is connected to base portion 12 can be positioned on a planar surface such as a floor. First and second armrest members 20, 22 are fixedly connected to base portion 12 and provide occupant arm support and additional features that will be further described herein.

A plurality of sinuous wire members 24 can be suspended over a cavity 26 created within a frame pan 28 of base portion 12. Sinuous wire members 24 provide vertical support for the weight of an occupant of furniture member 10, with the sinuous wire members 24 being allowed to downwardly elastically deflect into the cavity 26. According to several embodiments, sinuous wire members 24 are made of a spring steel material. When the weight of the occupant is supported by sinuous wire members 24, back support portion 14 provides a back or back rest support for the occupant of furniture member 10. A leg rest extension device 30 such as a hand lever or switch can be used to extend and/or retract an occupant leg rest 32 (shown in a fully retracted position).

Back support portion 14 can be formed from wood members such as first and second side frame members 34, 36 which are connected to a rear frame member 38. A lumbar support system 40 can be movably connected to rear frame member 38. Lumbar support system 40 is positioned to support the lumbar area of the occupant when the occupant is seated on base portion 12, including deflection of sinuous wire members 24. A support position (forward and rearward location) of lumbar support system 40 can be varied from the free state position shown in FIG. 1 when no occupant is seated in furniture member 10, to a passive state when furniture member 10 is occupied. The support position can be varied either automatically as described further herein, or by occupant selection including to a tension adjusted or aggressive state as shown and described in better detail in reference to FIGS. 4-6. Lumbar support system 40 therefore provides both passive support and active adjustable support for the lumbar region of the occupant of furniture member 10.

Lumbar support system 40 includes a lumbar belt member 42 having a flexible body portion 44 which according to several embodiments can be a woven belt of an elastically flexible material such as but not limited to polyethylene. Opposite ends of flexible body portion 44 are connected such as by sewing or adhesively bonding to a substantially inelastic body portion 46. According to several embodiments inelastic body portion 46 can be a woven or molded belt of a substantially longitudinally inflexible material such as polyamide material. Lumbar belt member 42 is supported at opposite ends by first and second rotating drums 48, 50.

Figure 2:
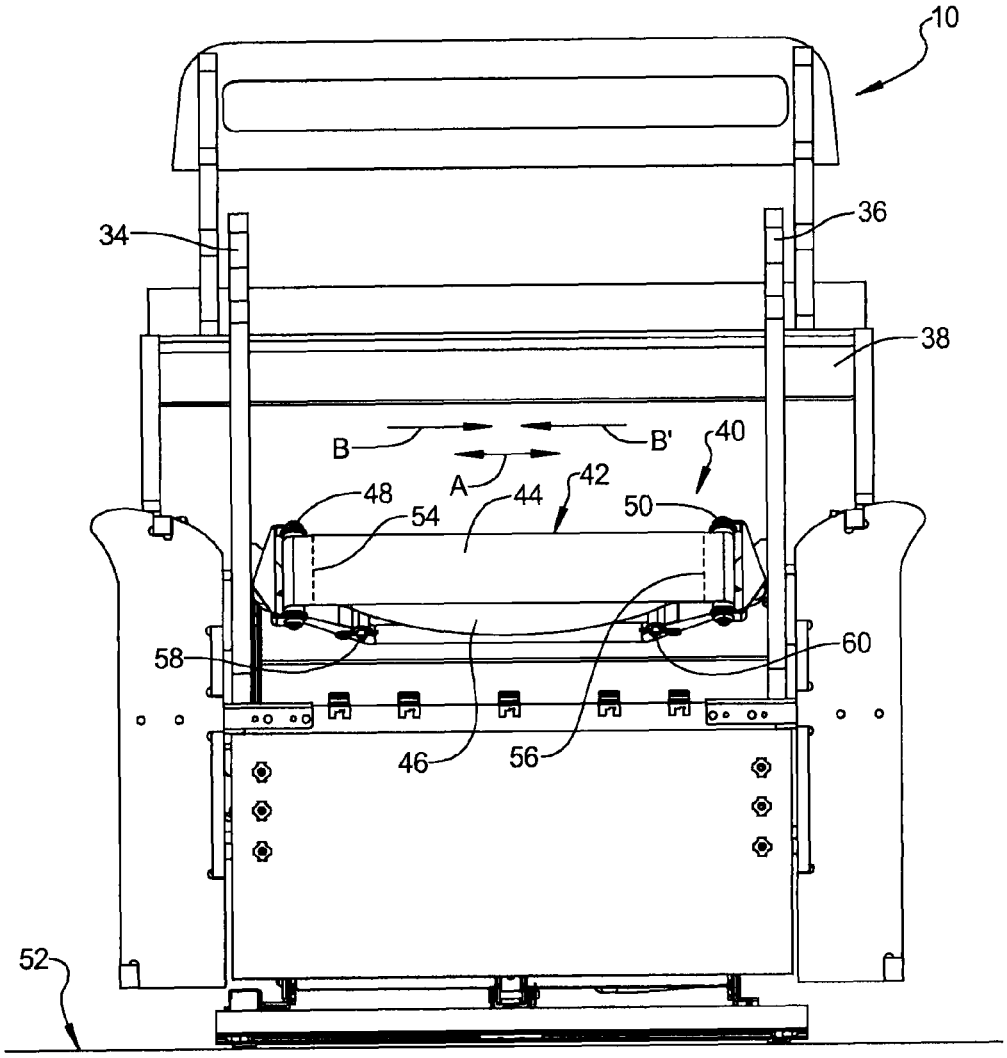
FIG. 2 is a front elevational view of the furniture member of FIG. 1.

Referring to FIG. 2, lumbar belt member 42 is oriented horizontally and substantially parallel to a floor surface 52 upon which furniture member 10 is supported. Lumbar belt member 42 can be stretched or tensioned to increase the resistance to bending by stretching as shown by arrows "A" and can be relaxed to decrease the resistance to bending by movement in the direction of arrows "B". Inelastic body portion 46 can be fixed or otherwise non-releasably connected to flexible body portion 44 at opposed first and second ends 54, 56. First and second ends 54, 56 when connected define sewn, bonded, adhesively joined, riveted, or similarly fixed connections of the material of inelastic body portion 46 and flexible body portion 44. First and second tensioning members 58, 60 are individually connected to opposite ends of lumbar belt member 42. First and second tensioning members 58, 60 are used to increase or decrease longitudinal tension and therefore the stiffness of lumbar belt member 42. According to several embodiments, first and second tensioning members 58, 60 are fasteners such as pins, hex-headed bolts, or the like.

Figure 3:
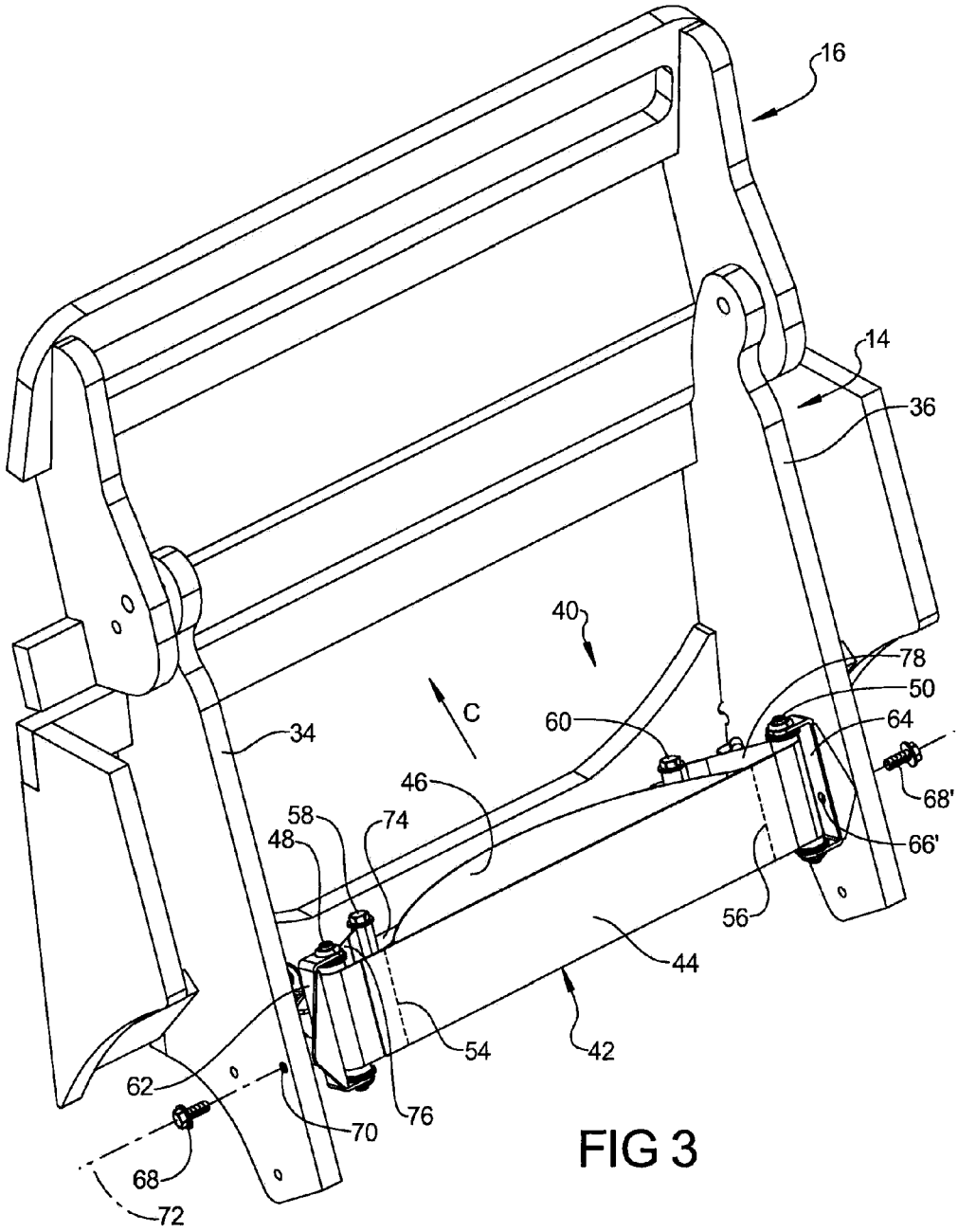
FIG. 3 is a front right perspective view of the lumbar support system of FIG. 1 connected to a back support portion of the furniture member.

Referring to FIG. 3, lumbar support system 40 is supported by first and second side frame members 34, 36 of back support portion 14 using first and second bracket assemblies 62, 64, each having a bracket aperture 66, 66' (bracket aperture 66 is not visible in this view) which individually receive a first or second fastener 68, 68' through a first or second frame aperture 70, 70' (frame aperture 70' is not visible in this view) created through first and second side frame members 34, 36. Lumbar support system 40 is longitudinally axially rotatable about an axis 72 defined through fasteners 68, 68', frame apertures 70, 70', and bracket apertures 66, 66'. From the free state of lumbar belt member 42 shown, flexible body portion 44 is deflectable by the force of an occupant seated against back support portion 14 in a rearward direction "C" until flexible body portion 44 contacts and/or conforms to the shape of inelastic body portion 46 which thereafter substantially stops further rearward deflection of flexible body portion 44. When the force of the occupant is released, flexible body portion 44 will elastically return to the free state (non-deflected condition) shown in FIG. 3.

A support member 74 such as a shaped hollow tube is connected to and spatially separates the first and second bracket assemblies 62, 64, and can contact both first and second side frame members 34, 36. Support member 74 therefore provides lateral support for lumbar support system 40 while allowing rotation about axis 72. Opposed first and second connecting ends 76, 78 of lumbar belt member 42 are ends of flexible body portion 44 which in part conform to the shape of first and second rotating drums 48, 50 and thereafter extend rearwardly and are connected to first and second tension members 58, 60. Displacement of first and second tension members 58, 60, which will be further described in reference to FIGS. 4-6, increases or decreases a tension force and therefore the stiffness of flexible body portion 44.

Figure 4:
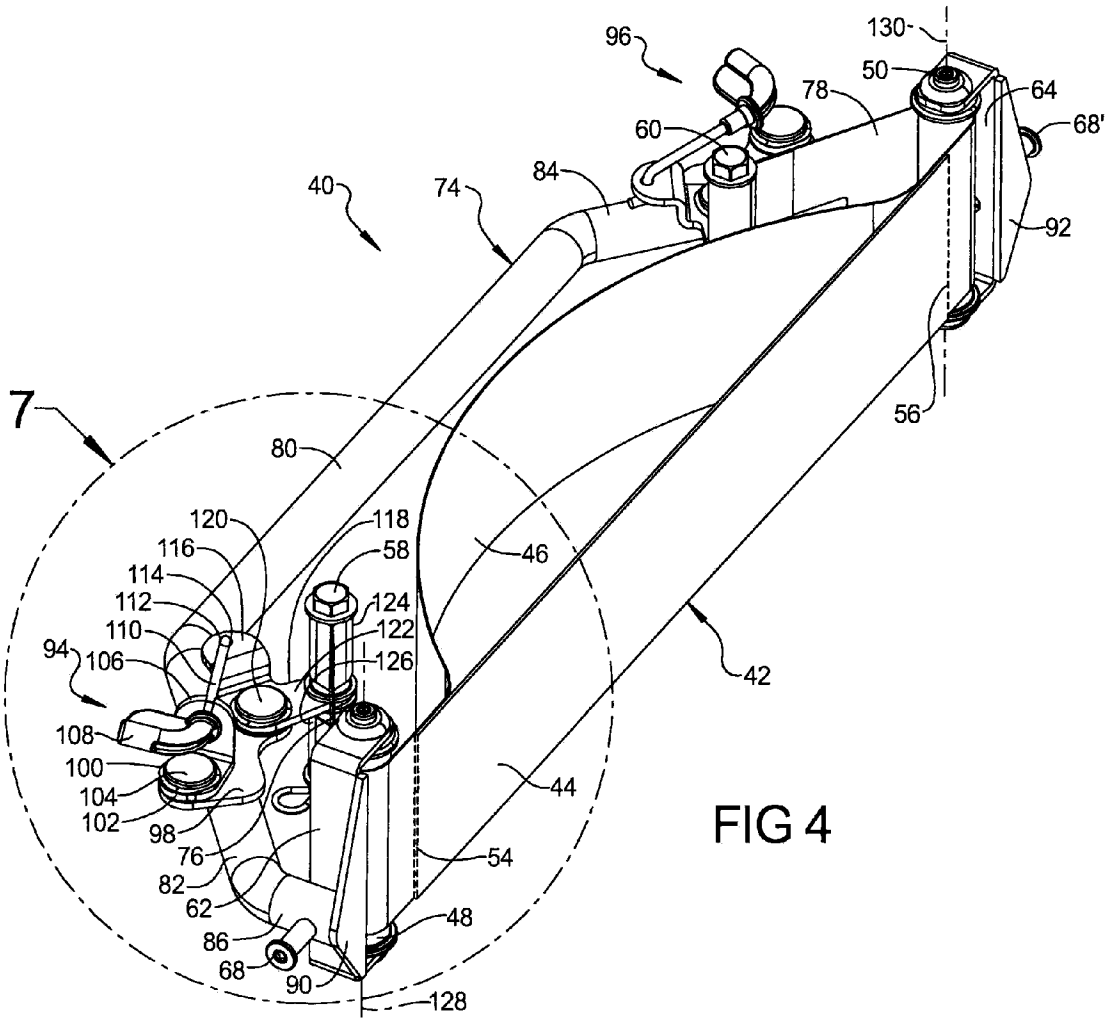
FIG. 4 is a front right perspective view showing a free state of the lumbar support system of FIG. 3.
Figure 5:
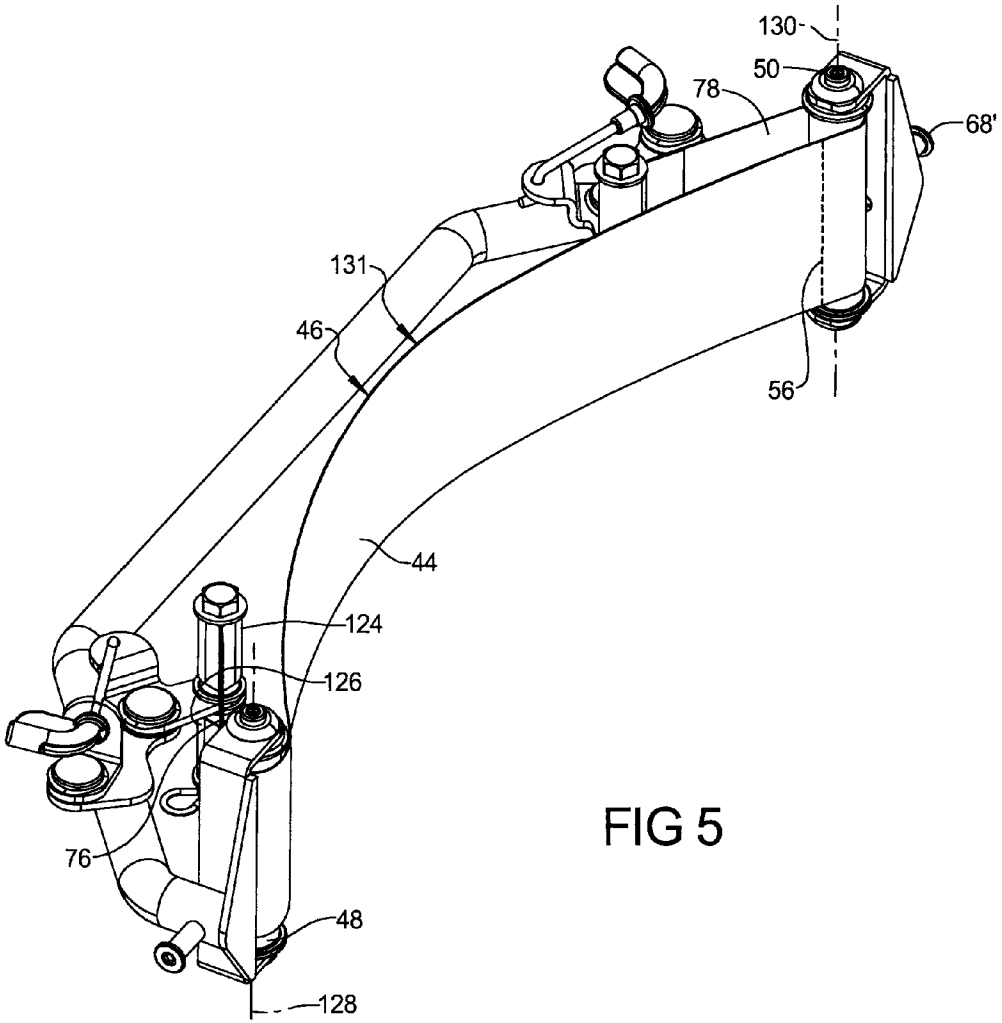
FIG. 5 is a front right perspective view similar to FIG. 4 showing a passive state of the lumbar support system.

Referring to FIG. 4, support member 74 includes a center tube portion 80 having mirror image first and second intermediate tube portions 82, 84 and first and second tube ends 86, 88 (second tube end 88 is not visible in this view). First and second tube ends 86, 88 can be oriented substantially transverse to center tube portion 80 and are connected such as by welding or fixing to first and second mounting flanges 90, 92 extending from first and second bracket assemblies 62, 64. A first stiffness and position adjusting mechanism 94 is fixedly connected to first intermediate tube portion 82. Similarly, a second stiffness and position adjusting mechanism 96 is fixedly connected to second intermediate tube portion 84. First and second position adjusting mechanisms 94, 96 are mirror image configurations of each other, therefore only first position adjusting mechanism 94 will be further discussed.

First position adjusting mechanism 94 includes a mechanism attachment plate 98 fixed for example by welding or fastening to first intermediate tube portion 82. A first bracket of an L-shaped bracket set 100, 100' includes a first bracket leg 102 rotatably connected to mechanism attachment plate 98 using a first rotational fastener 104 such as a spin rivet or the like such that first bracket 100 rotates with respect to a longitudinal axis of first rotational fastener 104. A second bracket leg 106 of first bracket 100 captures an end of a first cable sheath 108 from which a first flexible cable 110 slidably extends and retracts. First flexible cable 110 includes a connecting member 112 at a free end which is releasably connected in an aperture 114 of a first bracket arm 116 of a second bracket 118 of a second bracket set 118, 118'. Second bracket 118 is rotatably connected to mechanism attachment plate 98 using a second rotational fastener 120 such as a spin rivet or the like such that second bracket 118 rotates with respect to a longitudinal axis of second rotational fastener 120 when a force is applied to second bracket 118 by extension or retraction of flexible cable 110.

Second bracket 118 includes a second bracket arm 122 having an aperture through which first tensioning member 58 extends. The first connecting end 76 of lumbar belt member 42 is divided into first and second loop portions 124, 126 separated by a clearance opening (which will be described in better detail in reference to FIG. 6) which receives a portion of second bracket arm 122 during rotation of second bracket arm 122. First and second loop portions 124, 126 are looped about and therefore frictionally connect to first tensioning member 58 on opposite sides of second bracket arm 122. First and second loop portions 124, 126 can be created as closed loops requiring insertion of first tensioning member 58 through the closed loops such that first and second loop portions 124, 126 cannot release from first tensioning member 58 until first tensioning member 58 is longitudinally retracted out of first and second loop portions 124, 126. Retraction of flexible cable 110 into cable sheath 108 rotates second bracket 118 about the longitudinal axis of second rotational fastener 120 in a counter-clockwise direction as viewed in FIG. 4. This rotation moves first tensioning member 58 away from first rotating drum 48 which longitudinally elastically stretches and therefore elastically tensions the material of flexible body portion 44 of lumbar belt member 42. At the same time, an opposite rotation of second position adjusting mechanism 96 causes second tensioning member 60 to move away from second rotating drum 50, which further acts to tension the material of flexible body portion 44 of lumbar belt member 42.

An opposite or extending motion of flexible cable 110 outward with respect to cable sheath 108 results in a relaxation or reduction in the tension on the material of flexible body portion 44 of lumbar belt member 42. Either relaxing or increasing the tension of the material of flexible body portion 44 of lumbar belt member 42 causes opposite rotation of first and second rotating drums 48, 50 about drum rotational or longitudinal axes 128, 130 of first and second rotating drums 48, 50. First and second rotating drums 48, 50 therefore perform a similar function as an idler pulley, and further act to align the lumbar belt member 42 with the occupant's lumbar area.

Referring to FIG. 5 and again to FIG. 4, from the free state or non-deflected position of lumbar belt member 42 shown in FIG. 4, as the weight or rearwardly directed force of the occupant acts on flexible body portion 44 in rearward direction "C", the flexible material of flexible body portion 44 permits elastic deflection of flexible body portion 44 until contact is made with inelastic body portion 46 on at least one inelastic body portion location 131. Once this contact position is reached, defined herein as a passive state of lumbar support system 40, further rearward deflection of flexible body portion 44 is prevented by the longitudinal stiffness of inelastic body portion 46. Contact between flexible body portion 44 and inelastic body portion 46 can occur at a single inelastic body portion location 131, at multiple locations, and/or substantially continuously between the positions of the first and second ends 54, 56. Rearward deflection of flexible body portion 44 occurs between the free state and the passive state without significant rotation of first or second rotating drums 48, 50 about drum rotational or longitudinal axes 128, 130 and further without significant displacement of first or second connecting ends 76, 78.

Figure 6:
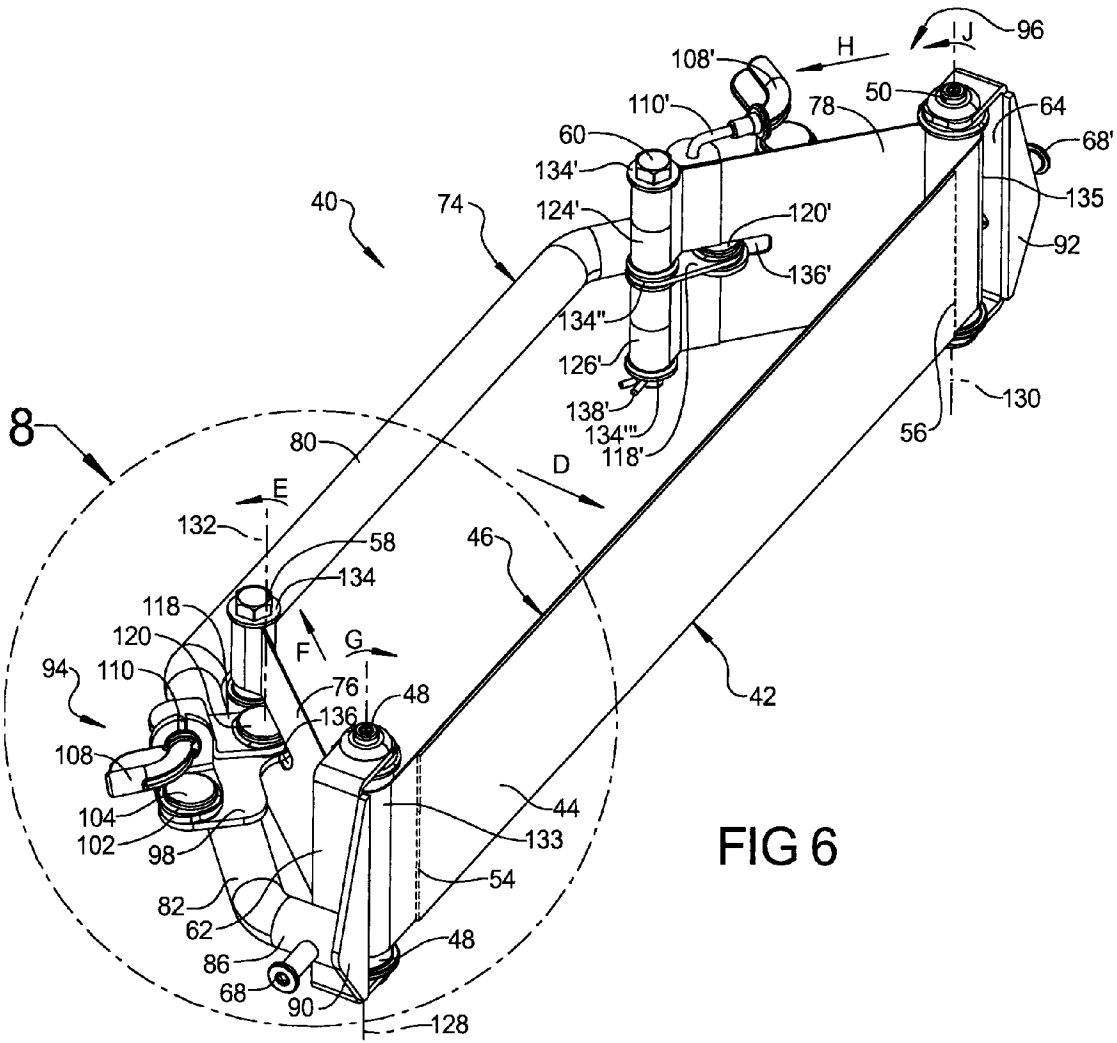
FIG. 6 is a front right perspective view similar to FIG. 4 showing a tensioned aggressive state of the lumbar support system.

Referring to FIG. 6, support or lumbar belt member 42 can be tensioned to elongate or stretch flexible body portion 44 until inelastic body portion 46 moves in a forward direction "D" to contact flexible body portion 44 defining a tensioned aggressive state of lumbar belt member 42. This is accomplished by operating one or both of the first and second position adjusting mechanisms 94, 96 as follows. Flexible cables 110, 110' are partially retracted into cable sheaths 108, 108' which causes a counterclockwise rotation (as viewed in FIG. 6) of second bracket 118 about an arc "E" with respect to a fastener longitudinal axis 132 of second rotational fastener 120. A similar but opposite motion of second position adjusting mechanism 96 can simultaneously occur, by retracting the free end portion of flexible cable 110' at least partially into cable sheath 108'. This causes a clockwise rotation of second bracket 118' with respect to a longitudinal axis (not clearly visible in this view) of second rotational fastener 120'.

First tensioning member 58 is thereby caused to move in a direction "F" which pulls first connecting end 76 generally inwardly and rearwardly, causing a portion 133 of inelastic body portion 46 to displace in a counterclockwise direction of rotation "G" about first rotating drum 48 with respect to drum longitudinal axis 128. Similarly, second tensioning member 60 is caused to move in a direction "H" which pulls second connecting end 78 generally inwardly and rearwardly, causing a portion 135 of inelastic body portion 46 to displace in a counterclockwise direction of rotation "J" about second rotating drum 50 with respect to drum longitudinal axis 130.

During the retraction motions of flexible cables 110, 110', first bracket legs 102, 102' rotate with respect to mechanism attachment plates 98, 98' (mechanism attachment plate 98' is not clearly visible in this view) by rotation about the axes of first rotation fasteners 104, 104'. This rotation permits flexible cables 110, 110' to axially align with the openings of cable sheaths 108, 108' to minimize wear between flexible cables 110, 110' and cable sheaths 108, 108'. To further reduce wear of components of lumbar support system 40, washers 134, 134' are placed between contact positions of first and second tensioning members 58, 60 with first and second loop portions 124, 126, and on opposite faces of second brackets 118, 118' in contact with first and second loop portions 124, 126. Clearance for rotational movement of first and second tensioning members 58, 60 during belt tensioning is provided by creating clearance openings 136, 136' in first and second connecting ends 76, 78 of lumbar belt member 42.

With continuing reference to FIG. 6, first and second tensioning members 58, 60 are similarly assembled, with the following discussion with respect to second tensioning member 60 equally applicable to first tensioning member 58. First and second loop portions 124', 126' of second connecting end 78 are aligned with an aperture created through second bracket 118'. Second tensioning member 60 is then slidably disposed sequentially through: washer 134', first loop portion 124', washer 134", the aperture of second bracket 118', second loop portion 126', washer 134'", and is then retained by engagement of retention element 138' through an end of second tensioning member 60. A portion of second bracket 118' and second rotational fastener 120' can extend through clearance opening 136' during the tensioning operation using flexible cable 110' as previously discussed herein. Rotation of second bracket 118' by retraction of flexible cable 110' causes displacement of second connecting end 78 in the direction "H", increasing tension on lumbar belt member 42 by elastically stretching flexible body portion 44.

Figure 7:
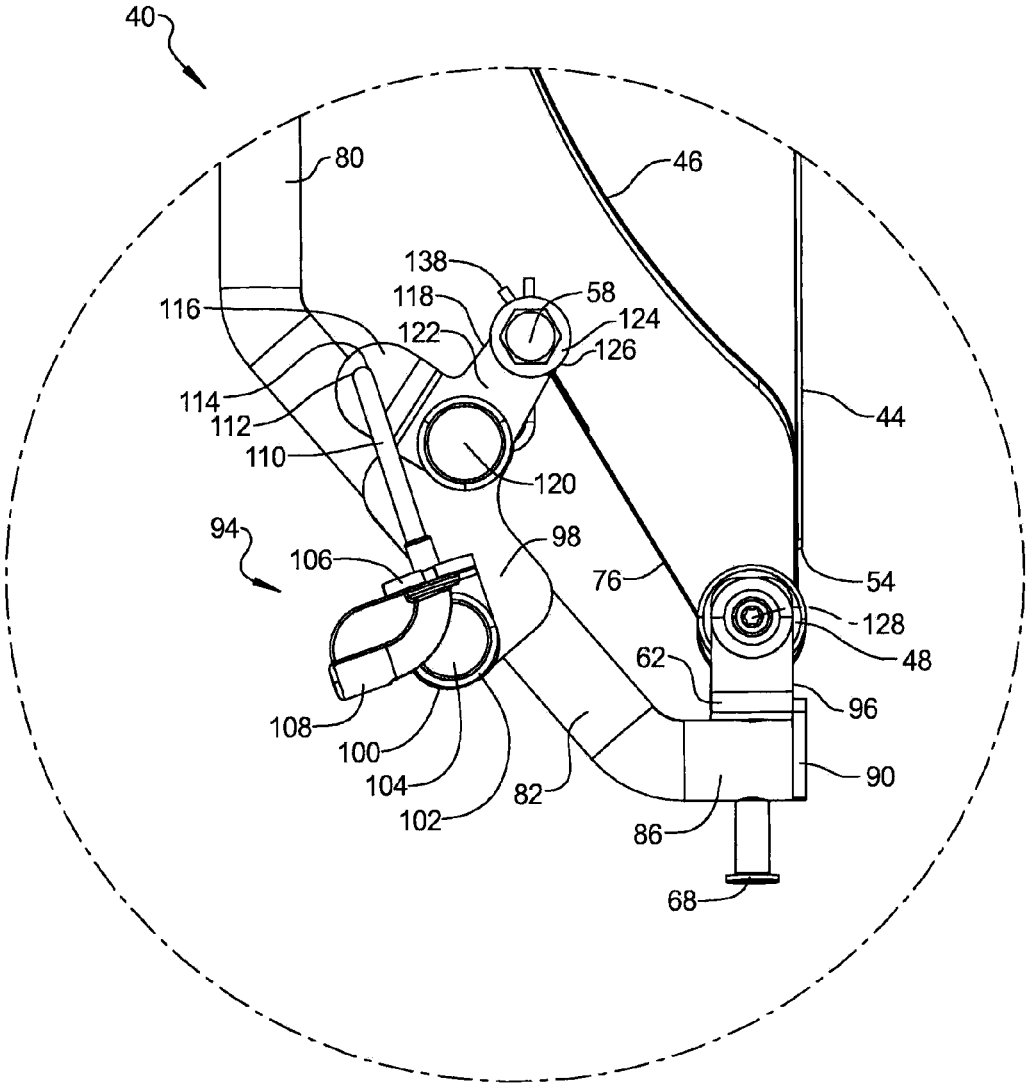
FIG. 7 is a top plan view of area 7 of FIG. 4.

Referring to FIG. 7, the free state of lumbar belt member 42 is shown. In the free state, inelastic body portion 46 is spatially separated from flexible body portion 44 except at the ends 54 56 (only end 54 is visible in this view). Flexible cable 110 is extended outwardly from cable sheath 108 such that flexible body portion 44 is oriented substantially vertically and parallel with first and second rotating drums 48, 50 (only first rotating drum 48 is visible in this view).

Figure 8:
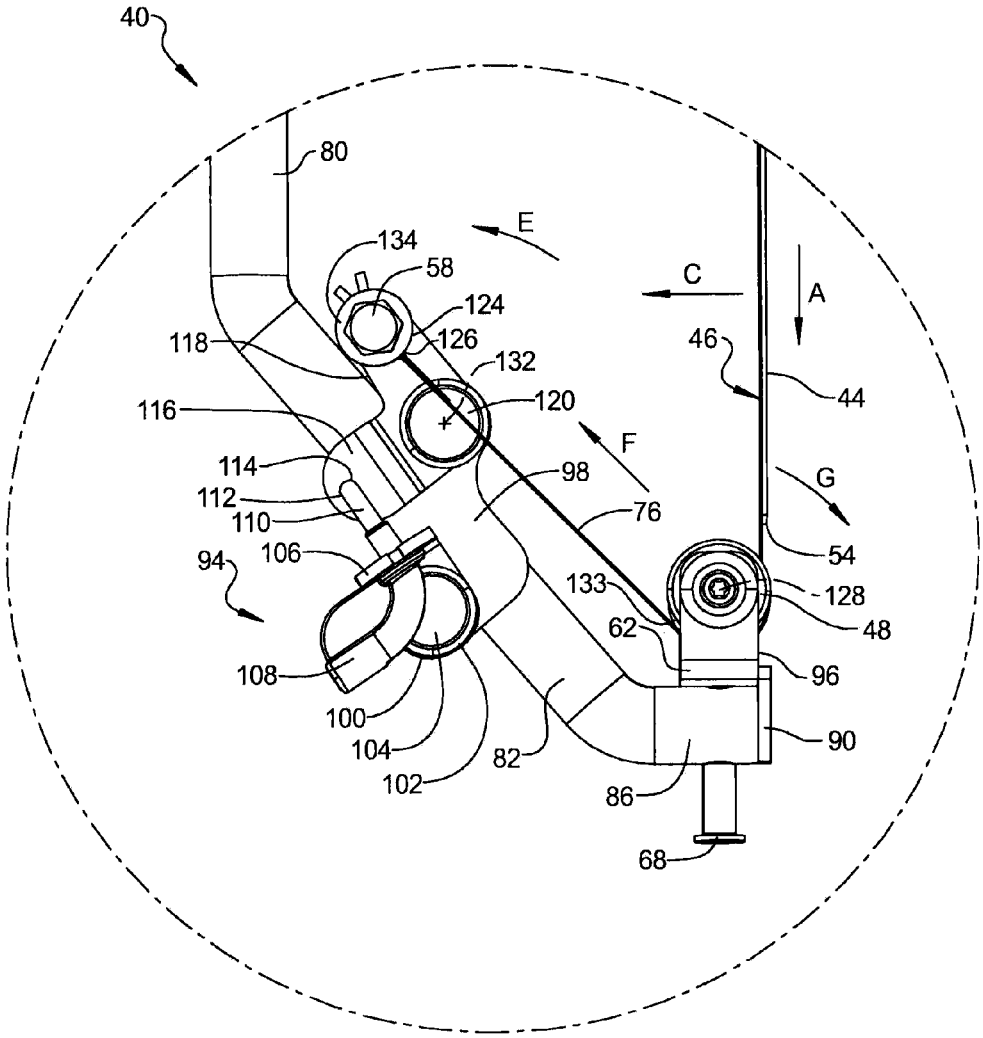
FIG. 8 is a top plan view of area 8 of FIG. 6.

Referring to FIG. 8 and again to FIG. 7, the aggressive state of lumbar belt member 42 is shown. To reach the aggressive state, flexible cable 110 has been partially retracted into cable sheath 108. This retraction rotates first bracket arm 116 of second bracket 118 in the counterclockwise direction "E" with respect to axis 132 of second rotational fastener 120. This co-rotates second bracket arm 122 of second bracket 118 which pulls first connecting end 76 in the direction "F". This motion pulls portion 133 of inelastic body portion 46 about first rotating drum 48 causing first rotating drum 48 to rotate in the clockwise direction "G". This longitudinally stretches flexible body portion 44 and end 54 both in the direction of arrow "A" until inelastic body portion 46 contacts flexible body portion 44. Contact of inelastic body portion 46 with flexible body portion 44 thereafter substantially precludes deflection of lumbar belt member 42 in the direction "C" between first and second rotating drums 48, 50, creating a stiff "feel" for lumbar belt member 42.

A lumbar support system of the present disclosure offers several advantages. An initial non-deflected position of the lumbar support system is provided. A flexible body in the form of a strap is able to deflect rearwardly from the weight of an occupant and elastically return to the non-deflected position. The flexible strap can also be biased to a tensioned position by the occupant, therefore providing an unlimited degree of adjustment to the occupant for lumbar support between a non-deflected free state, a deflected passive state, and a tensioned aggressive state of the lumbar support system. The use of lumbar support system 40 of the present disclosure provides for adjustable lumbar support for the occupant in any extended or fully retracted position of the leg rest assembly and for any position of the back support portion from a fully upright to a fully reclined position.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An occupant lumbar support system for a furniture member, comprising:

a belt member including:

a longitudinally elastically flexible first portion having first and second connecting ends; and a longitudinally rigid second portion having first and second ends, wherein the second portion is fixedly attached at first and second ends of the second portion to the first portion between the first and second connecting ends, the second portion spaced freely away from the first portion except at the attached first and second ends of the second portion thereby defining a belt member free state.

2. The lumbar support system of claim 1, further including at least one tensioning member connected to at least one of the connecting ends of the first portion, whereby operation of the at least one tensioning member longitudinally elastically stretches the first portion until the second portion moves into substantially continuous contact with the first portion between the first and second ends defining an aggressive state of the belt member.

3. The lumbar support system of claim 2, wherein the at least one tensioning member includes first and second tensioning members, the first tensioning member connected to the first connecting end and the second tensioning member connected to the second connecting end.

4. The lumbar support system of claim 3, further including a support tube oriented in parallel with the belt member having the first and second tensioning members fixedly connected to the support tube spatially separating the first and second tensioning members.

5. The lumbar support system of claim 4, further comprising first and second rotating drums individually rotatably connected to the support tube having portions of the belt member second portion in rotatable contact with the first and second rotating drums to align the first portion of the belt member with a lumbar region of an occupant of the furniture member.

6. The lumbar support system of claim 1, further comprising:

a furniture member having a back seat portion including first and second wings; and a support tube oriented in parallel with the belt member, the support tube having first and second brackets individually connected at opposed ends of the support tube each connected to one of the first and second wings.

7. The lumbar support system of claim 6, further comprising first and second fasteners individually connecting one of the first and second brackets to one of the first and second wings such that the lumbar support system is rotatable about a longitudinal axis defined by the first and second fasteners.

8. The lumbar support system of claim 1, wherein a belt member passive state is defined when a force of an occupant causes deflection of the first portion until the first portion contacts the second portion in at least one location between the first and second ends, the rigid second portion at the at least one location thereafter preventing further deflection of the first portion permitting the first portion of the belt member to align with a lumbar region of an occupant of the furniture member.

9. The lumbar support system of claim 1, further including:

a support tube oriented in parallel with the belt member;

first and second tube ends of the support tube oriented substantially perpendicular to a body of the support tube;

each of the first and second tube ends having a bracket fixed thereto; and first and second tensioning members each connected to one of the brackets, the second portion of the belt member being connected to each of the first and second tensioning members operating to longitudinally stretch the first portion.

10. An occupant lumbar support system for a furniture member, comprising:

a belt member including:

a longitudinally elastically flexible first portion having opposite first and second connecting ends; and a longitudinally inelastic second portion having opposite first and second ends of the second portion fixedly connected to the first portion between the first and second connecting ends, the second portion when spaced freely away from the first portion except at the first and second ends defining a belt member free state, the first and second connecting ends extending freely away from the first and second ends; and first and second tensioning members each connected to one of the first and second connecting ends whereby operation of the first and second tensioning members longitudinally elastically stretches the first portion until the second portion moves into substantially continuous contact with the first portion between the first and second ends defining a belt member aggressive state.

11. The lumbar support system of claim 10, wherein each of the first and second connecting ends includes first and second loop portions separated by a clearance opening, the first and second tensioning members inserted through the first and second loop portions of each of the first and second connecting ends.

12. The lumbar support system of claim 11, further including first and second sets of brackets each individually rotatably connected to one of a set of mechanism attachment plates, the first and second tensioning members individually inserted through individual ones of the second set of brackets.

13. The lumbar support system of claim 12, further including first and second cables each slidably inserted through one of first and second cable sheaths, the first and second cable sheaths each connected to individual ones of the first set of brackets, whereby retraction of the first and second cables at least partially into the first and second cable sheaths displaces the first and second tensioning members in a direction acting to elastically stretch the first portion.

14. The lumbar support system of claim 12, further including a support tube having the set of mechanism attachment plates fixedly connected thereto.

15. The lumbar support system of claim 14, further including:

first and second tube ends of the support tube oriented substantially perpendicular to a body of the support tube; and each of the first and second tube ends having a bracket assembly fixed thereto, each bracket assembly connected to one of a first and second wing of a furniture member back support portion.

16. A furniture member lumbar support system, comprising:

a furniture member back support portion rotatably connected to a base portion, the back support portion including opposed first and second wings; and a lumbar support system connected to the back support portion, the lumbar support system including:

a support tube connected to the first and second opposed wings;

a belt member having a longitudinally elastically flexible first portion and a longitudinally inelastic second portion fixedly attached at opposite first and second ends to the first portion; and first and second tensioning members connecting the belt member to the support tube.

17. The lumbar support system of claim 16, further comprising first and second bracket assemblies individually connected at opposed ends of the support tube and each connected to one of the first and second wings.

18. The lumbar support system of claim 17, further comprising first and second fasteners each connecting one of the first and second bracket assemblies to one of the first and second wings such that the lumbar support system is rotatable about a longitudinal axis defined by the first and second fasteners.

19. The lumbar support system of claim 16, wherein the belt member first portion includes opposite first and second connecting ends, each of the connecting ends including first and second loop portions both receiving one of the first or second tensioning members.

20. The lumbar support system of claim 19, further comprising first and second rotating drums each rotatably connected to the support tube and each rollably engaging one of the first and second connecting ends.

21. The lumbar support system of claim 16, wherein the belt member is adjustably positioned in a plurality of support states including at least a free state having the second portion spaced away from the first portion except at the first and second ends, a passive state having the first portion elastically deflected into contact with the second portion by a force of a furniture member occupant, and an aggressive state having the first portion longitudinally elastically stretched until the second portion contacts the first portion thereafter preventing further deflection of the first and second portions.

22. A furniture member lumbar support system connected to a back support portion of a furniture member, comprising:

a support tube connected to first and second opposed wings of the back support portion;

a belt member having a longitudinally elastically flexible first portion and a longitudinally inelastic second portion fixedly attached at first and second ends to the first portion, the first portion further including first and second connecting ends extending away from the first and second ends;

first and second tensioning members connected to the support tube and movably supporting the belt member; and first and second rotating drums each rotatably connected to the support tube and each rollably engaging one of the first and second connecting ends to align the first and second connecting ends with the first and second tensioning members.

23. The lumbar support system of claim 22, further comprising first and second bracket assemblies individually connected at opposed ends of the support tube.

24. The lumbar support system of claim 23, further comprising first and second fasteners each connecting one of the first and second bracket assemblies to the back support portion such that the lumbar support system is rotatable about a longitudinal axis defined by the first and second fasteners.

25. The lumbar support system of claim 22, wherein the first and second connecting ends each include first and second loop portions both receiving one of the first or second tensioning members.

26. A method for creating an occupant lumbar support system connected to first and second opposed wings of a furniture member back support member, the occupant lumbar support system including a flexible occupant lumbar belt member having an elastically extendable first portion and an inelastic second portion, a support tube, first and second tensioning members and first and second rotating drums, the method comprising:

connecting the support tube to the first and second opposed wings;

attaching the second portion of the belt member to the first portion at first and second ends of the second portion;

extending first and second connecting ends of the first portion away from the first and second ends of the second portion;

fixing the first and second connecting ends to first and second tensioning members; and rotatably connecting the first and second rotating drums to the support tube to rollably engage one of the first and second connecting ends to one of the first and second rotating drums to align the first and second connecting ends with the first and second tensioning members.

27. The method of claim 26, further comprising spacing the second portion from the first portion except at the first and second ends to create a free state of the belt member.

28. The method of claim 27, further comprising deflecting the first portion from the free state into contact with the second portion without rotating the rotating drums to create a passive state of the belt member.

29. The method of claim 26, further comprising moving the tensioning members away from the rotating drums to elastically stretch the first portion until the second portion contacts the first portion creating an aggressive state of the lumbar support system.

* * * * *